US006003588A

United States Patent [19]

Dang et al.

[11] Patent Number: 6,003,588

[45] Date of Patent: Dec. 21, 1999

[54] PROCESS FOR INTRODUCING CORES INTO A CASTING MOLD

[75] Inventors: Quy Dung Dang, Bruehl; Gerd Pawera, Erftstadt; Juergen Achenbach, Weilerswist, all of Germany

[73] Assignee: Eisenwerk Bruehl GmbH, Bruehl, Germany

[21] Appl. No.: 08/836,149

[22] PCT Filed: Jul. 4, 1996

[86] PCT No.: PCT/EP96/02943

§ 371 Date: Jun. 25, 1997

§ 102(e) Date: Jun. 25, 1997

[87] PCT Pub. No.: WO97/16271

PCT Pub. Date: May 9, 1997

[30] Foreign Application Priority Data

Oct. 27, 1995 [DE] Germany ..... 195 40 023

[51] Int. Cl.[6] ..... B22D 33/04; B22C 9/10

[52] U.S. Cl. ..... 164/137; 164/339; 164/186; 164/228; 164/368

[58] Field of Search ..... 164/137, 339, 164/186, 228, 368, 340, 341

[56] References Cited

U.S. PATENT DOCUMENTS

| | | | |
|---|---|---|---|
| 4,273,182 | 6/1981 | Winterhalter et al. | 164/137 |
| 4,809,763 | 3/1989 | Schilling | 164/137 |
| 5,730,200 | 3/1998 | Landna | 164/137 |

FOREIGN PATENT DOCUMENTS

| | | | |
|---|---|---|---|
| 0290809 | 1/1987 | European Pat. Off. . | |
| 62-13240 | 1/1987 | Japan | 164/368 |
| 62-230454 | 10/1987 | Japan . | |

*Primary Examiner*—Harold Pyon
*Assistant Examiner*—I.-H. Lin
*Attorney, Agent, or Firm*—Venable; George H. Spencer; Ashley J. Wells

[57] ABSTRACT

A process for inserting cores into a casting mold includes inserting a plurality of individual cores into a template; forming a core group by joining together the plurality of individual cores within the template using a bracing and securing device which is detachable; dipping the core group into a founder's black bath to provide a coated core group; drying the coated core group; inserting the core group after drying into the casting mold; and removing the bracing and securing device. The process advantageously additionally includes providing a plurality of core groups that form a core assembly for a casting mold; forming a core set by joining together the plurality of core groups using a bracing and securing device; dipping the core set into a founder's black bath to provide a coated core set; drying the coated core set; inserting the core set after drying into the casting mold; and removing the bracing and securing device. The plurality of cores have respective contact surfaces that touch each other, and the process advantageously includes providing an adhesive on at least some of the contact surfaces prior to inserting the plurality of cores into the template.

4 Claims, 1 Drawing Sheet

PROCESS FOR INTRODUCING CORES INTO A CASTING MOLD

CROSS-REFERENCE TO RELATED APPLICATION

This application is a 371 of PCT/EP 961 02943 filed on Jul. 4, 1996.

BACKGROUND OF THE INVENTION

Until now it was standard in foundry practice, in particular in the gray iron practice, to insert cores manually into one of the form boxes of the casting mold, comprised of at least two form boxes, which are designed for the production of thin-walled castings, e.g. motor blocks. In particular for the production of motor blocks made of gray iron, increasingly higher requirements must be met with respect to complexity of the motor block, weight savings, accuracy of measurements and surface quality. With respect to core production, this makes it necessary to produce cores with the highest possible filigree and with a very complex geometry, thereby reducing the subsequent processing of the motor blocks to a minimum. It has proven useful in this case to design the respective motor block such that bores, openings or the like, which so far had to be added in a subsequent processing step, are added from the start during the casting process. Owing to this, neighboring cores must have corresponding projections, which "hold open" these openings in the casting mold. However, it has turned out in this connection that burrs develop at the produced openings as a result of unavoidable wear and tear and as a result of deviations in the accuracy that are also unavoidable, especially in this area of contact between neighboring cores. These burrs must subsequently be reworked following the removal of the casting from the mold. It is the object of the invention to create a process that simplifies the insertion of the cores into such a casting mold and avoids a costly subsequent reworking.

SUMMARY OF THE INVENTION

The solution according to the invention lies in that the individual cores are introduced into a template, that the contiguous cores that form a core group are connected to one another in the template via bracing and securing means, that the group of connected cores is dipped into a founder's black bath and is dried, and that the dried core group is inserted into the casting mold and the bracing is subsequently released. Using this process has the advantage that at least some of the cores forming the core group are respectively provided with core prints, which can be designed such that on the one hand they make contact with each other and, on the other hand, they project over the actual, forming core surface to form corresponding contact surfaces, so that the cores in this case can be braced against each other with the aid of a corresponding bracing means, which is frame-shaped for example, can be mutually braced and secured to each other and thus can be handled as one unit. It is useful if the contact surfaces of the cores that touch each other are provided with a so-called green adhesive to further improve the cohesion. If this core group is dipped into a founder's black bath in accordance with the inventive process, and if this founder's black is dried following the draining off, then the unavoidable, relatively thin gaps in the region of the contact surfaces of adjoining individual cores are filled with the founder's black, thereby avoiding the formation of burrs. The core group is subsequently transported further with the aid of the bracing and securing means and is inserted into the prepared casting mold, e.g. a lower box, so that following the release of the bracing means, the upper box can be fitted on and the casting operation can proceed in the standard way.

Depending on the design of the casting to be produced, it is possible based on the inventive process to connect individual cores to each other to form a core group or also to combine several core groups to form a core set as a core assembly for a casting mold and to perform the individual process steps while they are braced in this way until they are inserted into the casting mold. This provides the option of handling even very complex core groups in this manner. It is also possible to connect projections provided for individual core parts, which until now were inserted individually into a casting mold, with the associated basic core during the core production, e.g. glue them on with an adhesive, so that this individual core with a complicated design per se, which is composed of two or more parts and is nevertheless included in the core group, can be provided with a coat of founder's black and can subsequently be inserted into the casting mold. It omits the additional inserting work required so far, which always resulted in the formation of burrs in the transitional region between the individual core and the associated basic core, since the formation of burrs at the place of attachment between the core set and the associated basic core is avoided by coating the complete core group with founder's black.

BRIEF DESCRIPTION OF THE DRAWINGS

The sole drawing figure schematically illustrates a flow chart of the process according to the invention.

The inventive process is explained in more detail in the following with the aid of a flow chart.

DESCRIPTION OF THE PREFERRED EMBODIMENTS

Figure 1:
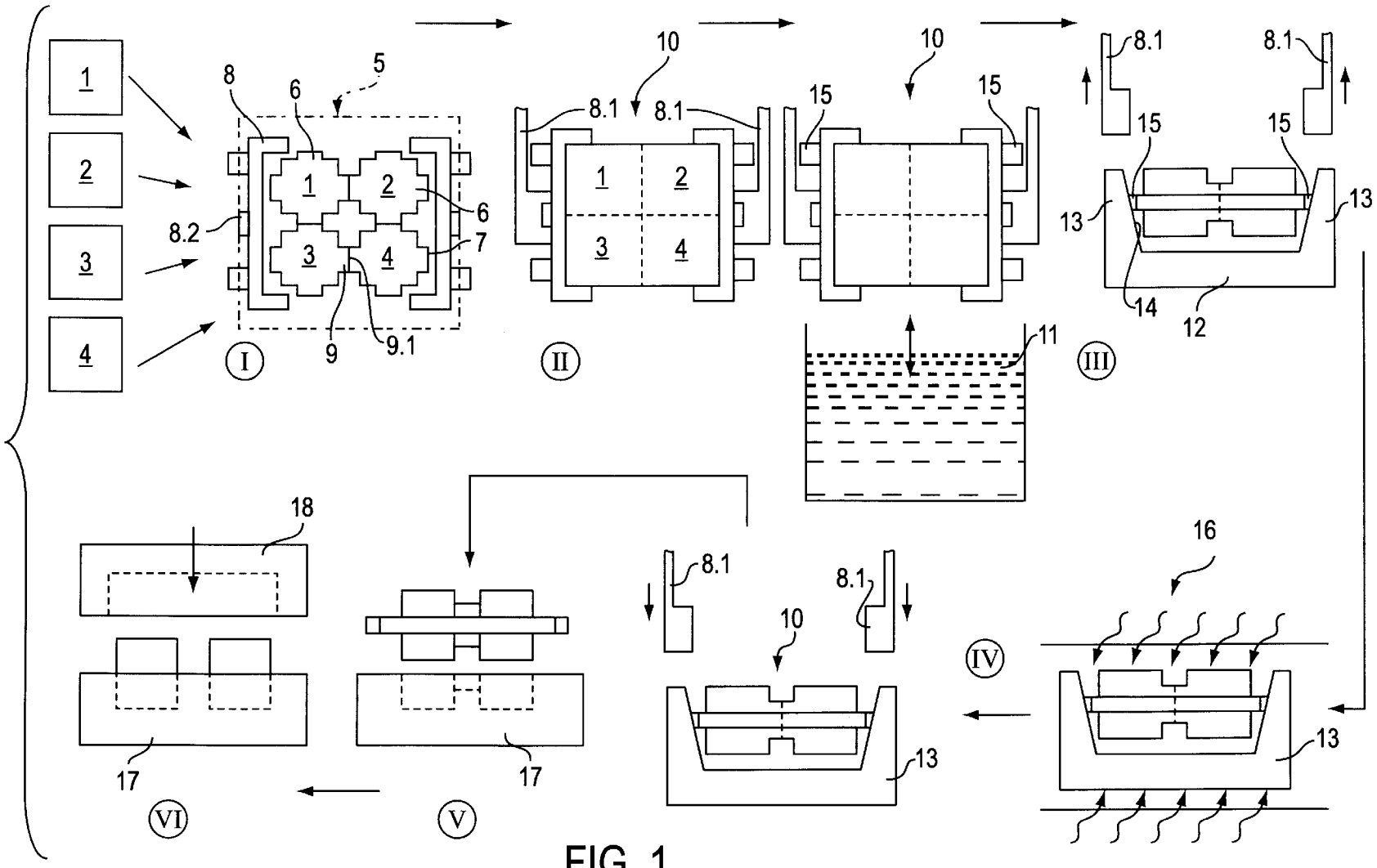

As can be seen in the drawing, four individual cores necessary for the production of a casting are formed in four core stations and are strengthened in the usual way.

The individual cores 1, 2, 3 and 4 are then inserted in process step I into a template 5, through which the mutual coordination of the cores 1, 2, 3, and 4 is fixed. The cores 1, 2, 3 and 4 are provided in the standard way with core prints 6 on the side pointing toward the outside. These core prints are designed such that they have a contact surface toward the outside, which in itself is suitably designed such that neighboring contact surfaces 7 are aligned.

The individual cores 1, 2, 3 and 4 that form a core group and are inserted into the template 5 are then braced fixedly with a bracing and securing means 8, which is frame-shaped for example, wherein the projections 9 on the individual cores 1, 2, 3 and 4 that are pointing toward each other and function either to create openings in the corresponding wall parts of the casting or are themselves shaped as core prints, depending on the design of the casting to be produced, are pushed together tightly. The cores can be provided with a so-called green adhesive on the facing contact surfaces 9.1, so that the fixation is further increased in this region through the adhesive effect. Thus, by designing the individual cores 1, 2, 3 and 4 correspondingly, it is possible to combine the individual cores via the bracing and securing means 8 to form a unit 10 for handling, as is shown for the following process step II. If designed accordingly, the bracing and securing means 8 can be clamped together with the means itself or by way of a gripping and bracing manipulator 8.1.

The core group that forms a unit 10 can subsequently be gripped in a process step III via the manipulator 8.1, which takes hold of the bracing and securing means 8 at the gripping lifter 8.2, can be transported further and dipped into a founder's black bath 11. The bracing and securing means 8 in this case can also be turned by the manipulator 8.1, so that excess founder's black can drain off following the dipping. Since the bracing and securing means 8, which is for example frame-shaped, holds the cores 1, 2, 3, and 4 that form a core group only in the core print region, the surfaces of the core group that form the corresponding regions of the casting are covered completely with founder's black during the subsequent casting, wherein especially the gaps between the individual, adjoining cores 1, 2, 3 and 4 are sealed by the founder's black, thus avoiding the formation of casting burrs.

In the subsequent process step IV, the unit 10 must then be moved to a drying installation 16 where the coat of founder's black is dried, e.g. through a combination microwave and air drying process.

The unit is deposited by the manipulator 8.1 on a moving furnace carrier 12 so that it can be moved through the drying installation. The furnace carrier 12 has clamping carriages 13 on two facing sides, which are inclined toward each other with their inward-pointing clamping surfaces 14 that open toward the top. Clamping lifters 15 are arranged on both sides of the gripping lifter 8.2 on the bracing and securing means 8, which clamping lifters respectively project over the gripping lifter and are provided with a counter surface that is inclined such that it corresponds to the clamping surface 14, so that the bracing and securing means 8 is clamped tightly between the side jaws 13 when the unit 10 is deposited on the furnace carrier 12. Following that, the manipulator 8.1 can be removed and the complete assembly can be moved into the drying installation 16.

After the drying process is completed, the core group combined in the unit 10 is lifted with the manipulator 8.1 from the furnace carrier 12 and is then inserted in the next process step V into the lower box 17 or into a mounting template of a prepared casting mold. Only then is the frame-shaped bracing and securing means 8 released and removed from the core group. The upper box 18 is placed in a subsequent process step VI on top of the lower box 17 and connected tightly with it, so that the casting operation can be carried out subsequently.

From the above description of the process sequence for a diagrammatic embodiment with a core group composed of four individual cores, it is obvious that even very complicated castings can be produced with the process according to the invention. With a corresponding design of the bracing and securing means, it is thus definitely possible to connect to each other several core groups that form a complete core assembly for a casting mold, which must not be connected to each other based on the configuration of the casting, and to keep these together during the following treatment, meaning during the coating with a founder's black and the subsequent drying until insertion into the casting mold.

It is readily evident that combining individual cores to form core groups and/or combining core groups to form complete core sets, will minimize the expenditure for the transport and the individual operational steps such as dipping, drying and inserting of the cores into the casting mold. Insofar as the individual cores have coordinated projections designed to create break-outs in the finished casting, which projections are sealed off by the coating with founder's black of the complete core group or the core set, this will reduce the subsequent cleaning operations, in particular the removal of burrs on the finished casting. The additional advantage of the inventive process lies in that the dimensional accuracy is improved through the insertion of a complete core group and/or a complete core set into the casting mold, thus minimizing the number of rejections.

Another advantage of the inventive method consists in that the cycle times for casting the finished forms can be increased since the time required for inserting the cores is reduced considerably.

A further advantage of the inventive method also lies in the fact that it allows a higher flexibility with respect to client demands or modifications. It is only required here that the cores must be designed such that neighboring cores, even if these do not have projections for forming break-outs between them and thus must have core prints anyway, are designed such that the core prints, which are required in any case, will be in direct contact, so that a bracing with the respective design of the core prints is possible on the outside via a preferably frame-shaped bracing and securing means.

The inventive process also allows combining two or more core groups that belong together and form a complete core set in a joint bracing and holding means, without the individual core groups themselves having to make contact via a corresponding arrangement of projections. Thus, it is possible to use the inventive process even if individual core groups do not have a joint bracing plane with respect to their core prints. In that case, it is possible to brace together the individual core groups in a main frame with separate bracing and securing means and to handle them in this way during the following process steps, until they are inserted into the casting mold.

What is claimed is:

1. A process for inserting cores into a casting mold, comprising:

inserting a plurality of individual cores into a template;

forming a core group by joining together the plurality of individual cores within the template using a bracing and securing means which is detachable;

dipping the core group into a founder's black bath to provide a coated core group;

drying the coated core group;

inserting the core group after drying into the casting mold; and removing the bracing and securing means.

2. The process according to claim 1, wherein the plurality of cores of each core group have respective contact surfaces that touch each other, and wherein the process further comprises providing an adhesive on at least some of the contact surfaces prior to inserting the plurality of cores of each core group into the template.

3. The process according to claim 1, further comprising:

providing a plurality of core groups that form a core assembly for a casting mold;

forming a core set by joining together the plurality of core groups using a bracing and securing means;

dipping the core set into a founder's black bath to provide a coated core set;

drying the coated core set;

inserting the core set after drying into the casting mold; and removing the bracing and securing means.

4. The process according to claim 3, wherein the plurality of cores have respective contact surfaces that touch each other, and wherein the process further comprises providing an adhesive on at least some of the contact surfaces prior to inserting the plurality of cores into the template.

* * * * *